US008344250B2

(12) United States Patent
Padro

(10) Patent No.: US 8,344,250 B2
(45) Date of Patent: Jan. 1, 2013

(54) LOW PROFILE ELECTRICAL DEVICE ASSEMBLY

(75) Inventor: Kenny Padro, Hamden, CT (US)

(73) Assignee: Hubbell Incorporated, Shelton, CT (US)

( * ) Notice: Subject to any disclaimer, the term of this patent is extended or adjusted under 35 U.S.C. 154(b) by 211 days.

(21) Appl. No.: 13/010,221

(22) Filed: Jan. 20, 2011

(65) Prior Publication Data

US 2012/0188667 A1 Jul. 26, 2012

(51) Int. Cl.
*H01R 13/46* (2006.01)

(52) U.S. Cl. ..... 174/53; 174/58; 439/145; 439/535

(58) Field of Classification Search ..... 174/53, 174/58; 439/93, 137, 145, 502, 535, 549
See application file for complete search history.

(56) References Cited

U.S. PATENT DOCUMENTS

| | | | |
|---|---|---|---|
| 1,928,638 | A | 10/1933 | Avery |
| 2,433,917 | A | 1/1948 | McCartney |
| 2,872,503 | A | 2/1959 | Winter |
| 2,895,119 | A | 7/1959 | Montgomery, Jr. |
| 3,156,761 | A | 11/1964 | Schinske |
| 3,192,499 | A | 6/1965 | West |
| 3,369,211 | A | 2/1968 | Sundquist |
| 3,641,472 | A | 2/1972 | Phillips, Jr. |
| 3,879,101 | A | 4/1975 | McKissic |
| 3,952,244 | A | 4/1976 | Spear |
| 3,967,195 | A | 6/1976 | Averitt et al. |
| 3,975,074 | A | 8/1976 | Fuller |
| 3,975,075 | A | 8/1976 | Mason |
| 4,008,940 | A | 2/1977 | Foley |
| 4,015,201 | A | 3/1977 | Chaffee |
| 4,034,284 | A | 7/1977 | Peplow |
| 4,082,995 | A | 4/1978 | Rhude |
| 4,105,968 | A | 8/1978 | Mobley |
| 4,118,690 | A | 10/1978 | Paynton |
| 4,127,807 | A | 11/1978 | Peplow |
| 4,152,639 | A | 5/1979 | Chaffee |
| 4,203,638 | A | 5/1980 | Tansi |
| 4,217,619 | A | 8/1980 | Tibolla |

(Continued)

OTHER PUBLICATIONS

SNAPConnect(TM) Get Connected in a Snap with Hubbell (Sales Brochure); www.hubbell-wiring.com; Apr. 2007; 4 pp.

(Continued)

*Primary Examiner* — Dhirubhai R Patel
(74) *Attorney, Agent, or Firm* — Marcus R. Mickney; Mark S. Bicks; Alfred N. Goodman

(57) ABSTRACT

An electrical device assembly includes an electrical device and a plug connector adapted to be received thereby. The electrical device includes a housing having a rear surface and an aperture in the rear surface. A ground strap is connected to the housing and is adapted to secure the electrical device to an electrical box. A plurality of contact blades are disposed in the electrical device and are accessible through the aperture. One of the contact blades is a ground contact blade. A conductive member extends between the ground contact blade and the ground strap. The plug connector includes a plurality of contact members adapted to engage the plurality of contact blades in the electrical device. A plurality of wires extend outwardly from the plurality of contact members such that the plurality of wires are substantially parallel to the rear surface of the electrical device when the plug connector is connected to the electrical device, thereby providing an electrical device assembly having a low profile.

20 Claims, 10 Drawing Sheets

U.S. PATENT DOCUMENTS 4,273,957 A 6/1981 Kolling, Jr.
4,280,092 A 7/1981 Wells, Jr. et al.
4,477,141 A 10/1984 Hardesty
4,485,282 A 11/1984 Lee
4,544,219 A 10/1985 Barkas
4,725,249 A 2/1988 Blackwood et al.
4,842,551 A 6/1989 Heimann
4,865,556 A 9/1989 Campbell et al.
5,006,075 A 4/1991 Bowden, Jr.
5,015,203 A 5/1991 Furrow
5,069,630 A 12/1991 Tseng et al.
5,113,045 A 5/1992 Crofton
5,117,122 A 5/1992 Hogarth
5,146,385 A 9/1992 Misencik
5,178,555 A 1/1993 Kilpatrick et al.
5,224,009 A 6/1993 Misencik
5,266,039 A 11/1993 Boyer et al.
5,281,154 A 1/1994 Comerci et al.
5,285,163 A 2/1994 Liotta
5,297,973 A 3/1994 Gorman
5,456,373 A 10/1995 Ford
5,472,350 A 12/1995 Mehta
5,546,657 A 8/1996 Mehta et al.
5,582,522 A 12/1996 Johnson
5,625,285 A 4/1997 Virgilio
5,642,052 A 6/1997 Earle
5,654,857 A 8/1997 Gershen
5,785,551 A 7/1998 Libby
5,839,908 A 11/1998 Bonilla
5,876,243 A 3/1999 Sangawa
5,964,618 A 10/1999 McCarthy
5,975,925 A 11/1999 Tiberio, Jr.
5,975,938 A 11/1999 Libby
6,028,268 A 2/2000 Stark et al.
6,045,374 A 4/2000 Candeloro
6,054,849 A 4/2000 Collier
6,072,317 A 6/2000 Mackenzie
6,156,971 A 12/2000 May
6,218,844 B1 4/2001 Wong
6,309,248 B1 10/2001 King
6,323,652 B1 11/2001 Collier
6,341,981 B1 1/2002 Gorman
6,376,770 B1 4/2002 Hyde
6,377,427 B1 4/2002 Haun et al.
6,457,988 B1 10/2002 Andersen
6,494,728 B1 12/2002 Gorman
6,563,049 B2 5/2003 May
6,657,144 B2 12/2003 Savicki, Jr. et al.
6,692,284 B1 2/2004 Koh
6,737,582 B2 5/2004 Van Lieu et al.
6,753,471 B2 6/2004 Johnson
6,767,245 B2 7/2004 King
6,774,307 B2 8/2004 Kruse
6,814,611 B1 11/2004 Torres
6,843,680 B2 1/2005 Gorman
6,855,007 B2 2/2005 Irish et al.
6,870,099 B1 3/2005 Schultz et al.
6,939,179 B1 9/2005 Kieffer, Jr. et al.
6,982,558 B2 1/2006 Bryndzia
6,994,585 B2 2/2006 Benoit et al.
7,052,313 B2 5/2006 Gorman
7,057,401 B2 6/2006 Blades
7,068,038 B2 6/2006 Mason
7,091,723 B2 8/2006 Simmons
7,189,110 B1 3/2007 Savicki, Jr.
7,195,517 B1 3/2007 Savicki, Jr.
7,199,587 B2 4/2007 Hurwicz
7,248,056 B2 7/2007 Waldschmidt
7,259,567 B2 8/2007 Sears
7,265,291 B1 9/2007 Gorman
7,285,009 B1 10/2007 Benoit et al.
7,367,121 B1 5/2008 Gorman
7,385,406 B1 6/2008 Blades
7,407,410 B1 8/2008 Benoit et al.
7,470,145 B1 12/2008 Savicki, Jr. et al.
7,497,725 B2 3/2009 Savicki, Jr. et al.
7,501,926 B2 3/2009 Watchorn et al.
7,510,429 B1 3/2009 Savicki, Jr. et al.
7,528,609 B2 5/2009 Savicki, Jr. et al.
7,722,389 B2 5/2010 Benoit et al.
7,736,175 B1 6/2010 Savicki, Jr. et al.
7,749,018 B1 7/2010 Benoit et al.
7,754,967 B2 7/2010 Kruse et al.
7,762,838 B2 7/2010 Gorman
7,780,470 B2 8/2010 Benoit et al.
7,790,982 B2 * 9/2010 Weeks et al. ..... 174/50
7,820,909 B2 * 10/2010 Castaldo et al. ..... 174/53
8,013,242 B1 * 9/2011 Thibault et al. ..... 174/53
2002/0052139 A1 5/2002 Gorman
2002/0055301 A1 5/2002 Gorman
2006/0103390 A1 5/2006 Simmons et al.
2009/0186500 A1 7/2009 Benoit et al.
2009/0197461 A1 8/2009 Benoit et al.

OTHER PUBLICATIONS

Leviton Maunfacturing Co., Inc.; lev-lok(TM) Modular Receptacles (Sales Brochure); www.leviton.com/industrial; 2008; 5 pp.
Leviton Manufacturing Co., Inc.; The Wire Simplifier lev-lok(R) (Sales Brochure); www.leviton.com/industrial; 2009; 2 pp.
Cooper Industries, Ltd.; ArrowLink(TM) Modular Wiring Devices; Cooper Wiring Devices (Sales Brochure); www.cooperwiringdevices.com; 2009; 28 pp.
Richter et al., Practical Electrical Wiring, 1993, 16th Edition, McGraw-Hill, U.S.; pp. 137-139, 176-177, 507-510.
Bryant Wiring Device Catalog BDB-1506, May 1994, pp. C12, D12, D16, F2 and F5.
Leviton Wring Device Catalog, D-200, 1978, Little Neck, NY, pp. C1, T9, T12.
Pass & Seymour Plug Tail Wiring Devices Brochure; Apr. 2004.
First Alert, User's Manual for Smoke and Fire Alarms, Jul. 2004; Mexico, pp. 1-6.
Earley et al., NEC 1999 National Electrical Code Handbook, NFPA, 8th ed. (1999) pp. v-vii, 2, 69-70 and 98.
BRK Electronics, User's Manual—Smoke Alarms Jun. 2000.
T. Engdahl, Telephone Ringing Circuits, 1997, www.tkk.fi/misc/electronics/circuits/telephone_ringer.html.
P&S Plug Tail Installation—Speed Comparison Video, Pass & Seymour website (www.passandseymour.com/plugtail/video.cfm, Jun. 2007.
BRK Electronics (First Alert), Model SC6120B—User's Manual for AC Powered Smoke and Carbon Monoxide Alarm with Battery Back-Up and Silence Feature, 2001.
NEC 2005 Handbook, 2005, Article 314-17, Conductors Entering Boxes, Conduit Bodies, or Fittings, National Flre Protection Association, Inc. p 327.
UL Standard 514A, Metallic Outlet Boxes, Underwrites Laboratories Inc., Tenth Edition, 2004, p. 39.

* cited by examiner

LOW PROFILE ELECTRICAL DEVICE ASSEMBLY

FIELD OF THE INVENTION

The present invention relates to an electrical device assembly having a low profile. More particularly, the present invention relates to a GFCI device having a rear aperture for receiving a plug connector in which the wires terminated by the plug connector are substantially parallel to a longitudinal axis of contact members disposed within the plug connector. Still more particularly, the present invention relates to a GFCI device having a grounding member connecting a plug connector to a ground strap of the GFCI device.

BACKGROUND OF THE INVENTION

GFCI devices are designed to trip in response to the detection of a ground fault condition at an alternating current (AC) load. Generally, the ground fault condition results when a person or object comes into contact with the line side of the AC load and an earth ground at the same time, a situation which can result in serious injury.

GFCI devices interrupt a circuit path, typically at an AC receptacle, in response to the detection of a ground fault condition at an AC load. Ground fault circuit interrupters are used in utility power applications to protect against leakage currents that flow through ground rather than back through the source's neutral line. They are commonly found in residential settings where the utility power is used to operate household appliances. In operation, a GFCI type device supplies electricity to an exterior circuit and opens an outlet circuit when a ground fault occurs in the exterior circuit, i.e., when a portion of a circuit that is plugged into the outlet becomes grounded. GFCI devices commonly include a differential current transformer, control circuit, and a circuit breaker device. Typically, a GFCI device detects this condition by using a sensing transformer or wire coil to detect an imbalance between the currents flowing in the hot and neutral conductors of the AC supply, as will occur when some of the current on the line side is being diverted to ground. A ground fault condition happens when the current is diverted to the ground through another path, such as a human body, that results in an imbalance between the currents flowing in the phase and neutral conductors. When such an imbalance is detected, a circuit breaker within the ground fault circuit interrupter is immediately tripped to an open condition, thereby opening both sides of the AC line and removing all power from the AC load.

GFCI devices may be connected to fuse boxes or circuit breaker panels to provide central protection for the AC wiring throughout a commercial or residential structure. More commonly, however, GFCI devices are incorporated into electrical receptacles that are designed for installation at various locations within a building. This type of receptacle includes test and reset pushbuttons and a lamp or light-emitting diode (LED) indicating that the circuit is operating normally. When a ground fault occurs in the protected circuit, or when the test button is depressed, the GFCI device trips and an internal circuit breaker opens both sides of the AC line. The tripping of the circuit breaker causes the reset button to pop out and the LED to be extinguished, providing a visual indication that a ground fault has occurred. To reset the GFCI device, the reset button is depressed in order to close and latch the circuit breaker, and this also causes the LED to illuminate once again.

Some electrical receptacles have apertures in their rear faces for receiving a plug terminating a plurality of wires, as disclosed in U.S. Pat. No. 4,842,551 to Heimann. The wires terminated by the plug are connected to the existing wires in any suitable manner, such as by a clamp receptacle or a wire nut. Thus, an electrician is not required to connect the plug to the receptacle. However, providing a GFCI device with such a plug results in a large and obtrusive device, particularly in view of the plug wires extending perpendicularly with respect to a rear surface of the electrical receptacle. Accordingly, a need exists for an electrical receptacle, such as a GFCI device, having a plug that snaps into an aperture in the rear surface of the receptacle, thereby providing a receptacle and plug having a low profile.

SUMMARY OF THE INVENTION

Accordingly, it is a primary objective of the present invention to provide an electrical receptacle and plug having a low profile.

Another objective of the present invention is to provide a plug in which the terminated wires extend substantially parallel to a rear surface of an electrical receptacle to which the plug is connected.

A further objective of the present invention is to provide a GFCI device and plug having a low profile.

A still further objective of the present invention is to provide a GFCI device having an improved ground contact member electrically connecting the plug to a ground strap to provide the assembly with a low profile.

A still further objective of the present invention is to a provide a plug in which the terminated ends of the wires are substantially parallel to a longitudinal axis of contact members disposed in the electrical receptacle.

The foregoing objectives are basically attained by an electrical device assembly including an electrical device and a plug connector adapted to be received thereby. The electrical device includes a housing having a rear surface and an aperture in the rear surface. A ground strap is connected to the housing and is adapted to secure the electrical device to an electrical box. A plurality of contact blades are disposed in the electrical device and are accessible through the aperture. One of the contact blades is a ground contact blade. A conductive member extends between the ground contact blade and the ground strap. The plug connector includes a plurality of contact members adapted to engage the plurality of contact blades in the electrical device. A plurality of wires extend outwardly from the plurality of contact members such that the plurality of wires are substantially parallel to the rear surface of the electrical device when the plug connector is connected to the electrical device, thereby providing an electric device assembly having a low profile.

The foregoing objectives are also basically attained by a method of completing a circuit of a GFCI receptacle. A first or second circuit of the GFCI receptacle is completed by pushing a button a first or second distance. Pushing the button the first distance completes the first circuit by engaging a spring beam with a base of a rocker contact switch to trip the GFCI receptacle. Pushing the button the second distance completes the second circuit by moving the spring beam to move the base such that a second leg moves to contact a conductive member to put the GFCI receptacle in an end of life condition.

Other objects, advantages and salient features of the invention will become apparent from the following detailed description, which, taken in conjunction with the annexed drawings, discloses a preferred embodiment of the invention.

As used in this application, the terms "front," "rear," "upper," "lower," "upwardly," "downwardly," and other relative orientational descriptors are intended to facilitate the description of the switch assembly, and are not intended to limit the structure of the switch assembly to any particular position or orientation.

BRIEF DESCRIPTION OF THE DRAWINGS

The above aspects and features of the present invention will be more apparent from the description for an exemplary embodiment of the present invention taken with reference to the accompanying drawings, in which.

Throughout the drawings, like reference numerals will be understood to refer to like parts, components and structures.

DETAILED DESCRIPTION OF AN EXEMPLARY EMBODIMENT

Figure 1:
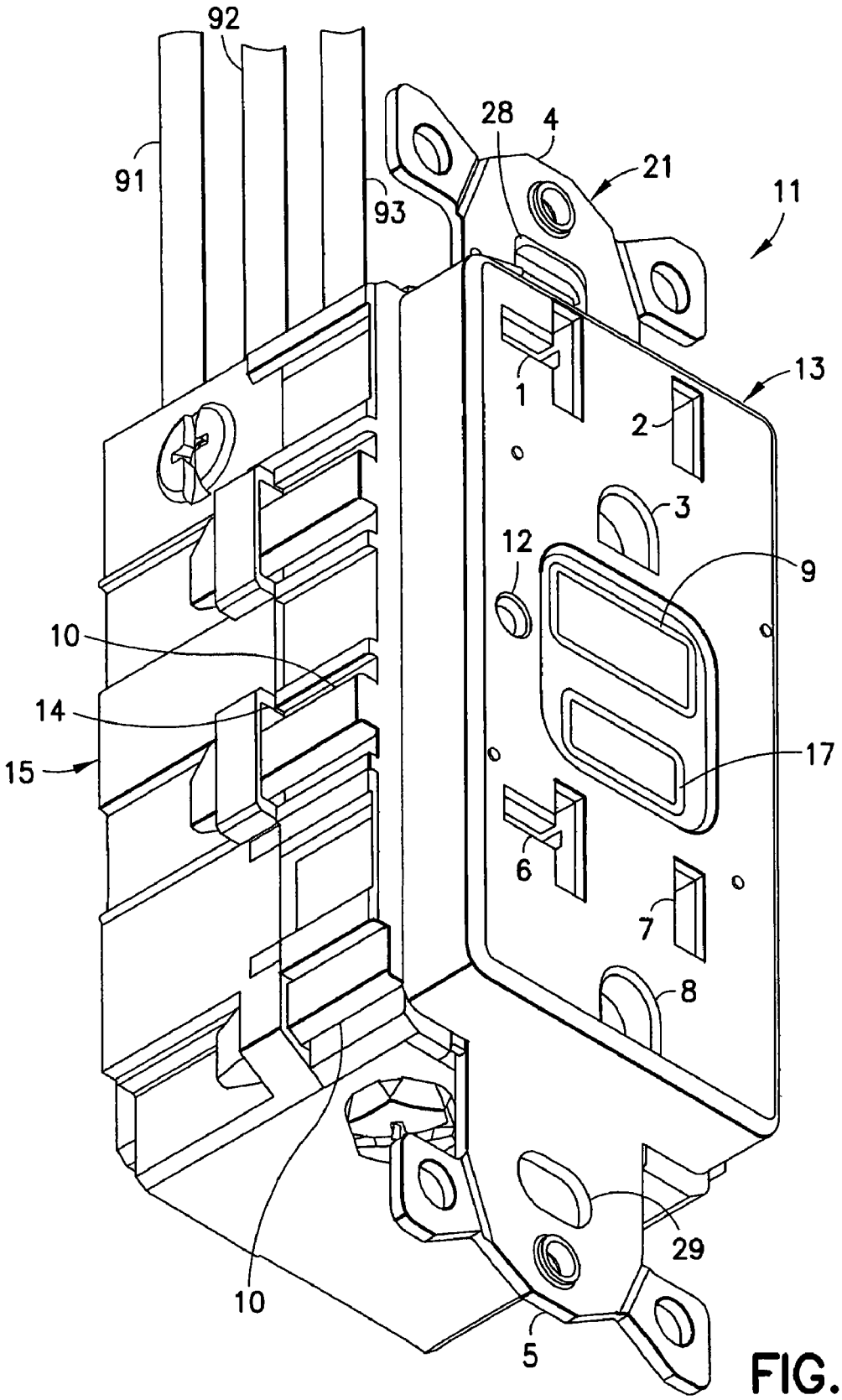
FIG. 1 is a front perspective view of a GFCI device according to an exemplary embodiment of the present invention.
Figure 2:
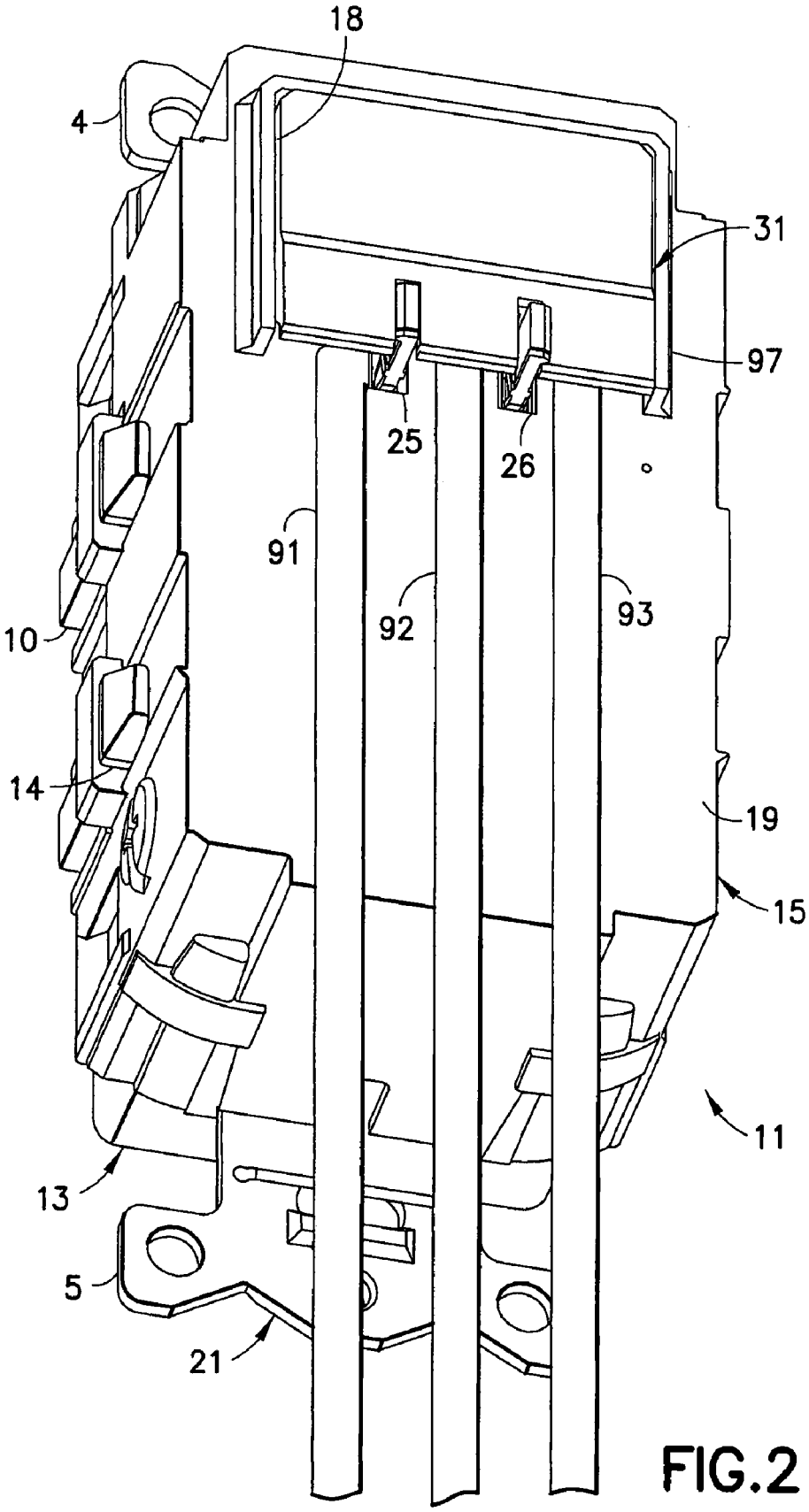
FIG. 2 is a rear perspective view of the GFCI device of FIG. 1.
Figure 3:
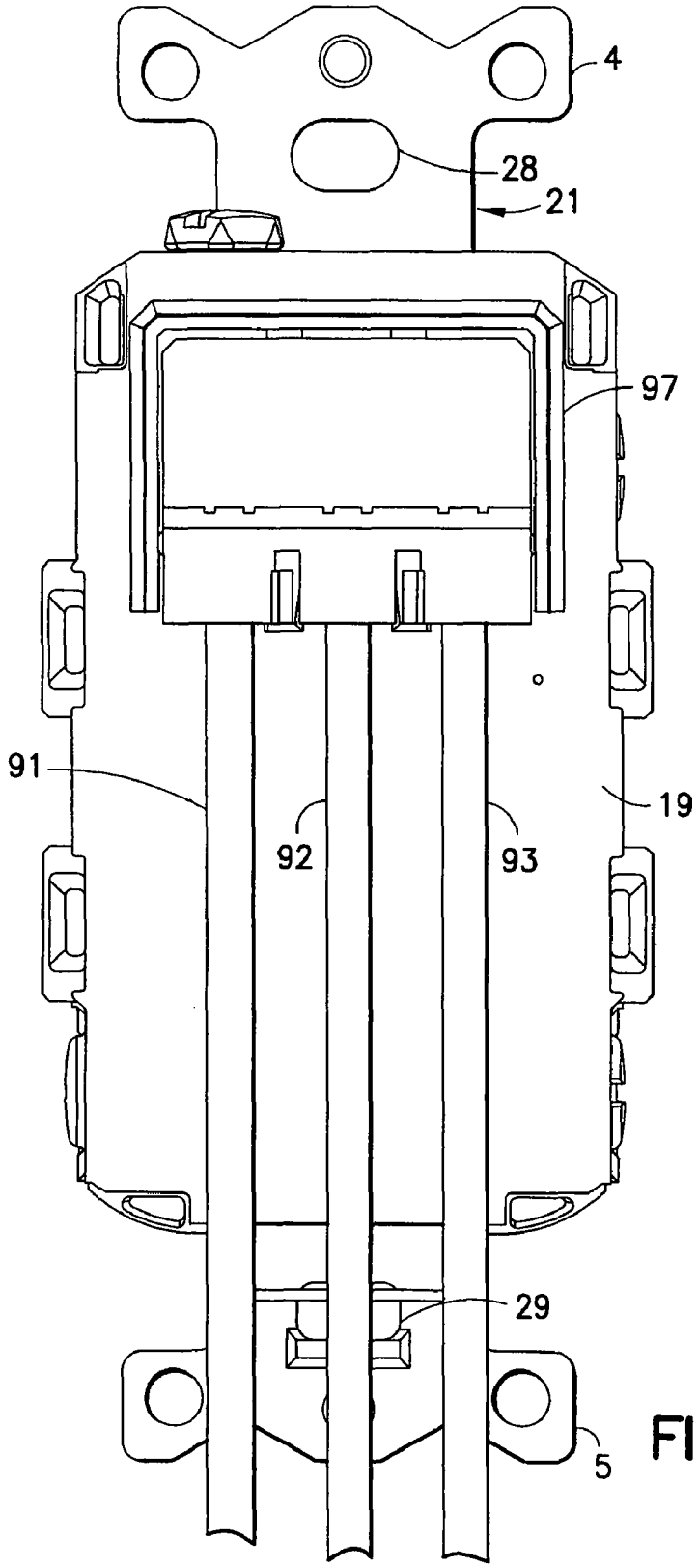
FIG. 3 is a rear elevational view of the GFCI device of FIG. 1.
Figure 4:
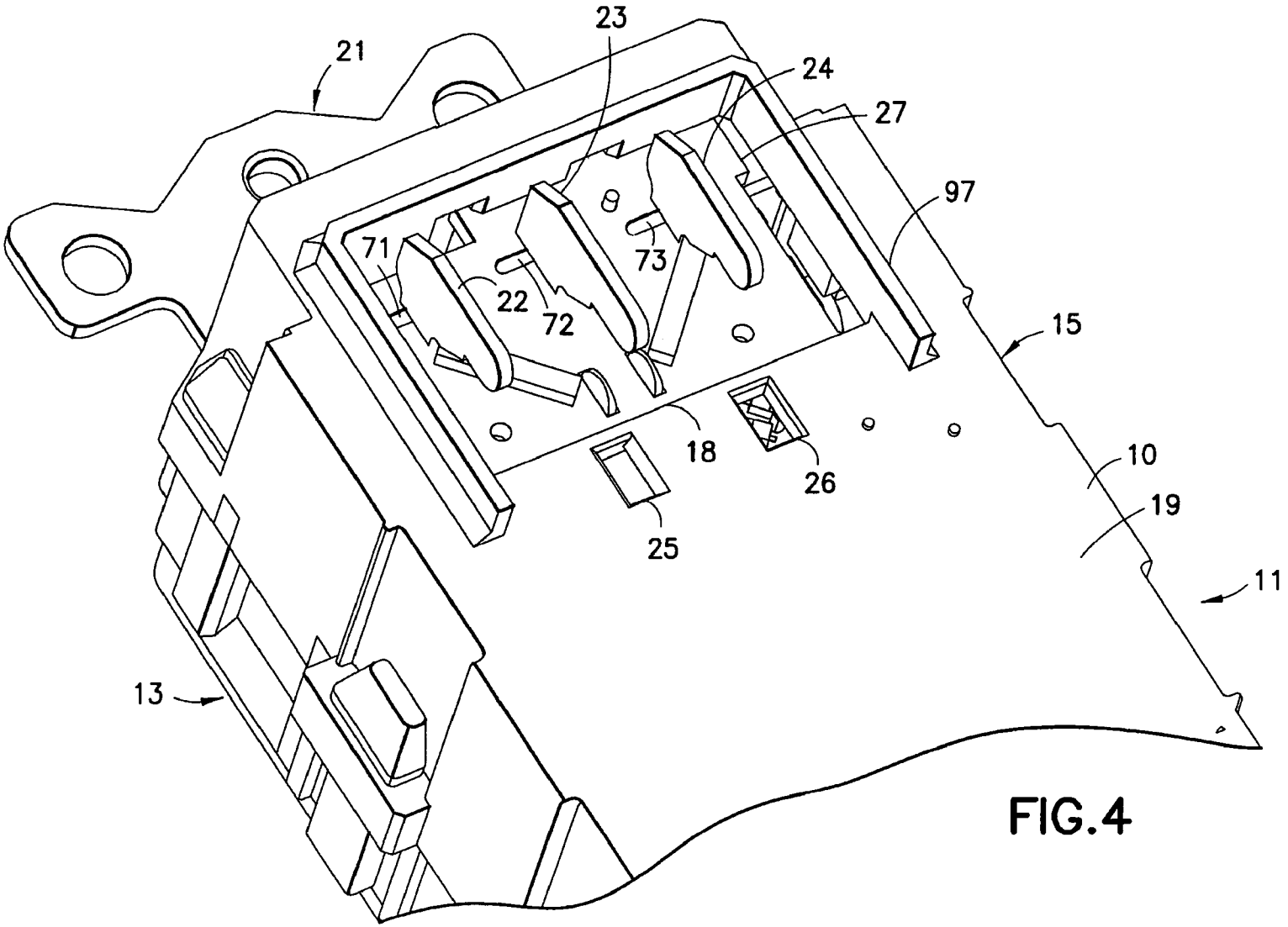
FIG. 4 is a partial rear perspective view of the GFCI device of FIG. 2 prior to inserting a plug connector.
Figure 5:
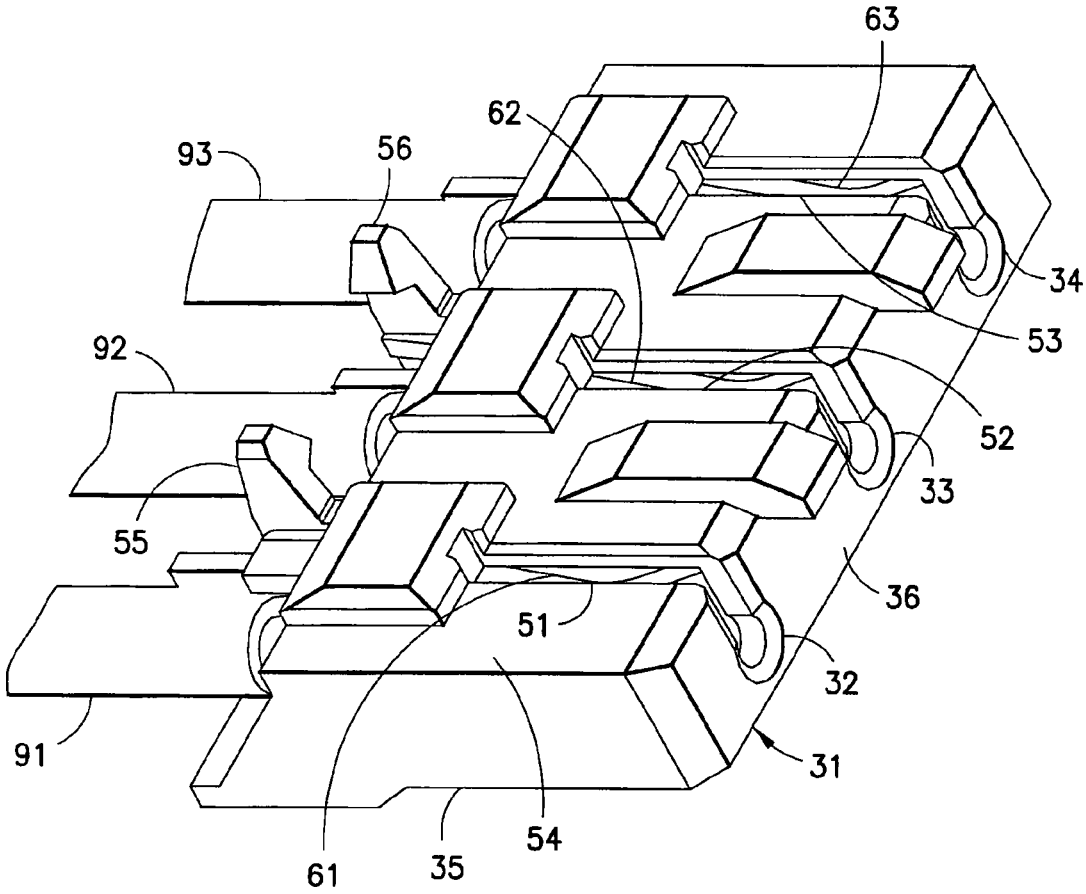
FIG. 5 is a perspective view of a plug connector of the GFCI device of FIG. 1.
Figure 6:
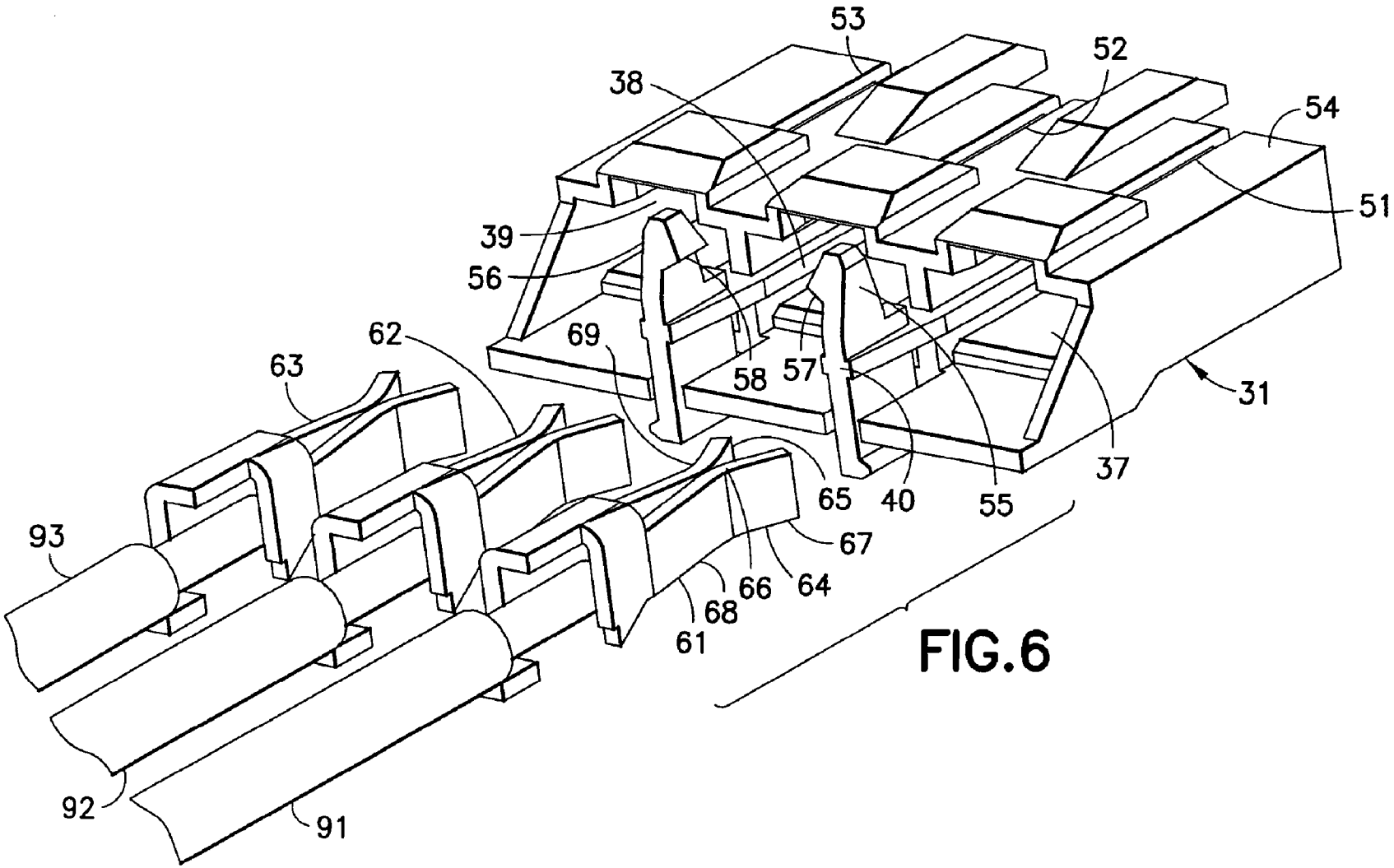
FIG. 6 is an exploded perspective view of the plug connector of FIG. 4.
Figure 7:
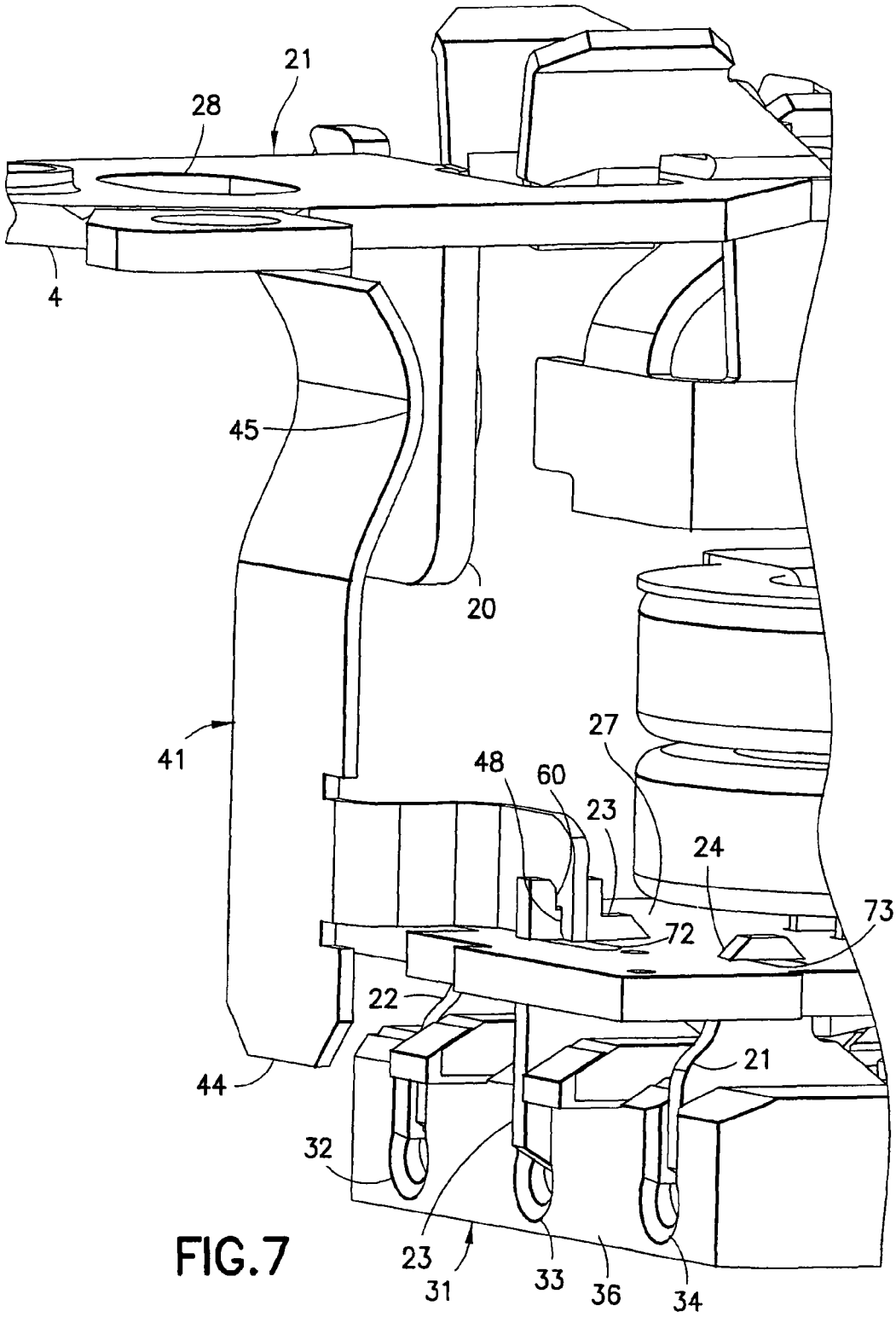
FIG. 7 is a perspective view of the plug connector engaging the contact blades, with the base and cover of the GFCI device of FIG. 1 removed for clarity.

An electrical device assembly in accordance with an exemplary embodiment of the present invention includes an electrical device or GFCI receptacle 11 and a plug connector 31 adapted to be received thereby, as shown in FIGS. 1-10. The electrical device 11 includes a housing having a rear surface 19 and an aperture 18 in the rear surface. A ground strap 21 is connected to the housing and is adapted to secure the electrical device 11 to an electrical box. A plurality of contact blades 22-24 are disposed in the electrical device 11 and are accessible through the aperture 18 (FIG. 4). One of the contact blades is a ground contact blade 23. A grounding member 41 extends between the ground contact blade 23 and the ground strap 21 (FIG. 7). The plug connector 31 includes a plurality of contact members 61, 62 and 63 adapted to engage the plurality of contact blades 22-24 in the electrical device 11 (FIG. 6). A plurality of wires extend outwardly from the plurality of contact members 22-24 such that the plurality of wires are substantially parallel to the rear surface 19 of the electrical device 11 when the plug connector 31 is connected to the electrical device, thereby providing a low profile electrical device assembly (FIG. 2).

Although the electrical device assembly in accordance with the exemplary embodiment of the present invention is described with respect to a GFCI device 11, the present invention is not so limited and any suitable electrical device may be used.

Figure 10:
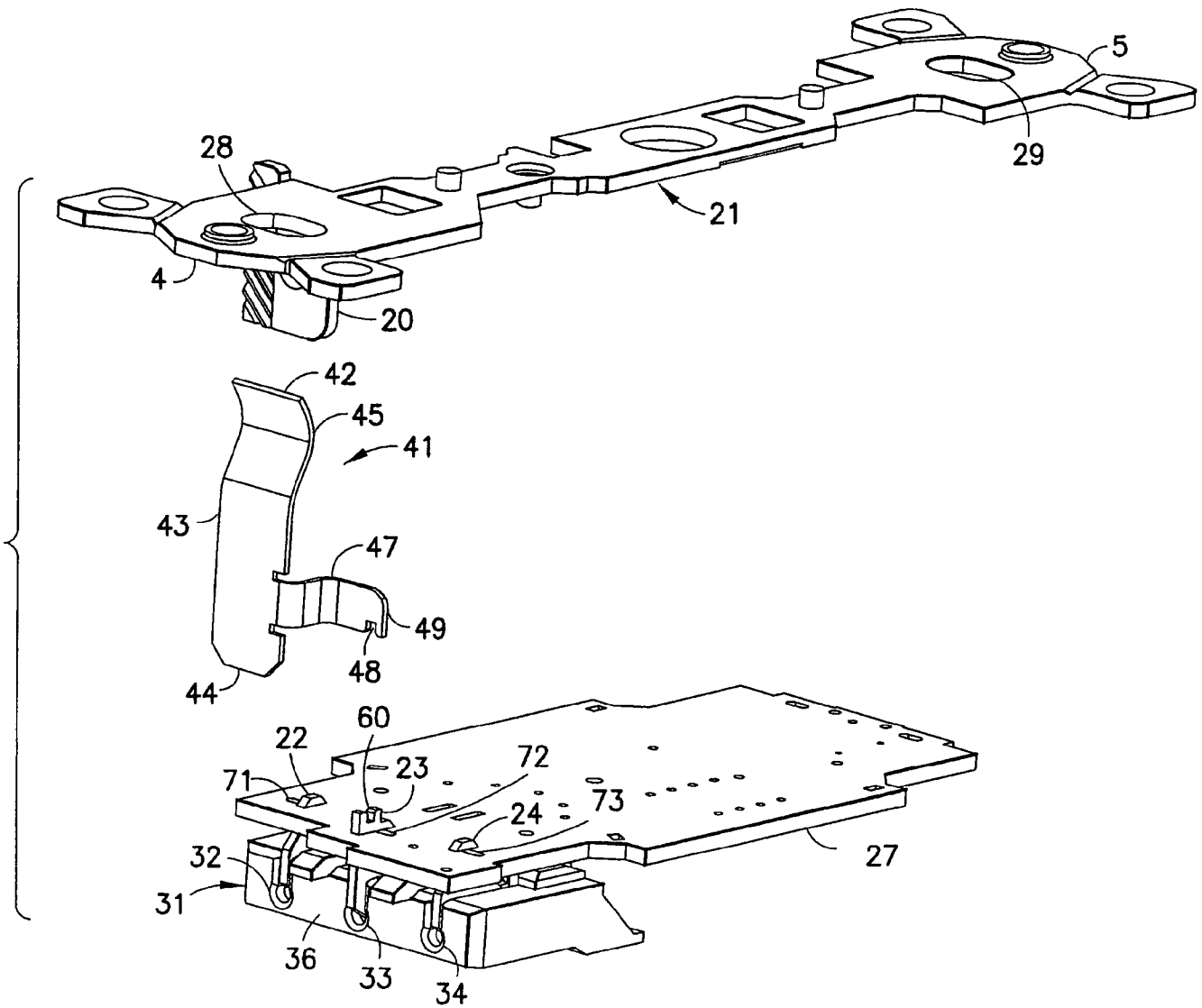
FIG. 10 is an exploded perspective view of the ground strap, grounding member, printed circuit board and plug of the GFCI device of FIG. 1.

The GFCI device 11 includes a cover 13 connected to a base 15, as shown in FIGS. 1-3. A ground or mounting strap 21 is connected to the GFCI device 11 to facilitate mounting the GFCI device to an electrical box (not shown). First and second mounting ears 4 and 5 are disposed at opposite ends of the ground strap 21. Each mounting ear 4 and 5 has an opening 28 and 29 to receive a fastener to secure the electrical receptacle 11 to an electrical box (not shown) in the conventional manner. The ground strap 21 may be disposed between the cover 13 and the base 15, or may wrap around the bottom surface 19 of the base. A grounding tab 20 extends downwardly from a lower surface 40 of the ground strap 21, as shown in FIGS. 7 and 10. Preferably, the grounding tab 20 extends substantially perpendicularly to the ground strap 21.

A test button 17 is movably connected to the cover 13. A reset button 9 is movably connected to the cover 13 proximal the test button 17. A status indicator 12, such as an LED light, is disposed on the cover 13 to indicate when the GFCI device is operating normally. A first plurality of openings 1, 2 and 3 are formed in the cover 13 to receive a first plug (not shown) of an electrical device to be powered by the receptacle 11. A second plurality of openings 6, 7 and 8 are formed in the cover 13 to receive a second plug (not shown) of an electrical device to be powered by the receptacle 11. The cover 13 has downwardly extending posts 10 that are receivable by pockets 14 of the base 15, thereby creating a snap fit to secure the cover to the base.

The rear surface 19 of the base 15 has an aperture 18, as shown in FIG. 4, for receiving the plug connector 31 that terminates building wires that supply electrical power. A perimeter wall 97 extends around at least a portion of the aperture. Three contact blades 22-24 are shown, although any suitable number of blades may be used. The outer contact blades 22 and 24 are power blades, hot and neutral contact blades, and the middle contact blade 23 is the ground contact blade. The contact blades 22-24 are connected to a printed circuit board 27, as shown in FIGS. 7 and 10. The contact blades 22-24 pass through slots 71, 72 and 73 in the circuit board 27 and are rotated to positions substantially perpendicular to the slots to secure the blades to the circuit board. Preferably, the contact blades 22-24 are soldered in place. The slots 71, 72 and 73 are shown in FIG. 4 as being elongated laterally (substantially perpendicular to a longitudinal axis of the circuit board) in the printed circuit board 27. The slots may be formed in any suitable orientation in the printed circuit board, and the ground blades oriented to be disposed longitudinally in the aperture 18. As shown in FIG. 4, a portion of each contact blade 22-24 extends below the slots in the circuit board, such that the contact blades are engageable by the plug contact members. A notch 60 is formed in a portion of the neutral contact blade 23 that extends above the printed circuit board, as shown in FIG. 10. Preferably, the outer (hot and neutral) contact blades 22 and 24 have substantially identical shapes.

Openings 25 and 26 are formed in the rear surface 19 of the base 15, as shown in FIG. 4. Preferably, the openings 25 and 26 are disposed proximal the aperture 18. The openings 25 and 26 are adapted to receive flexible arms of the plug connector 31 to connect the plug to the base 15 of the electrical device 11.

The plug connector 31 is described having three wires 91, 92 and 93 connected thereto, as shown in FIGS. 1-3, 5 and 6. Although the electrical device assembly of the exemplary embodiment of the present invention is shown with three wires, any suitable number of wires may be used as required by the electrical device used. The three wires 91, 92 and 93 are connected to the building wiring extending in a standard electrical box mounting the GFCI device 11.

The plug connector 31 is received by the aperture 18 in the base 15 of the GFCI device 11, as shown in FIGS. 2 and 3. A plurality of openings 32, 33 and 34 are disposed in a front face 36 of the plug housing 35, as shown in FIG. 5. Preferably, the plug housing 35 is unitarily formed as a one-piece member. A plurality of openings 37, 38 and 39 are formed in a rear face 40 of the plug connector 31, as shown in FIG. 12. A passageway is formed between each pair of corresponding openings, i.e., a passageway between openings 32 and 37, a passageway between openings 33 and 38, and a passageway between openings 34 and 39. Slots 51, 52 and 53 are formed in an upper surface 54 of the plug connector 31 that provide access to the passageways between the front and rear plug openings.

Latching arms 55 and 56 extends upwardly from the plug connector 31, as shown in FIGS. 5 and 6. The latching arms 55 and 56 are flexible to facilitate connecting to and disengaging from the GFCI device 11. The latching arms 55 and 56 are deflectable to disengage the plug connector 31 from a mated connection with the GFCI device 11. Latching tabs 57 and 58 extend inwardly from the latching arms 55 and 56, respectively, to engage an inner surface of the base 15 when inserted through the openings 25 and 26 to secure the plug connector 31 to the GFCI device 11. Inserting a tool through openings 25 and 26 flexes the latching arms 55 and 56 outwardly to disengage the latching arms from the inner surface of the base 15 such that the plug connector can be disconnected from the GFCI device 11.

Each of the wires 91, 92 and 93 is terminated by a contact member 61, 62 and 63, as shown in FIGS. 5 and 6. The wires 91, 92 and 93 are substantially parallel to a longitudinal axis of the contact members 61, 62 and 63. Contact member 61 has first and second flexible fingers 64 and 65, as shown in FIG. 6. Each of the fingers has a curved portion 66 with first and second portions 67 and 68 extending outwardly therefrom. The curved portions 66 and 69 of the flexible fingers 64 and 65 of the same contact member 61 contact each other to form a gripping potion therebetween to receive a contact blade. A gap is formed between the free ends of the flexible fingers 64 and 65 of the contact member 61. Each contact member 61, 62 and 63 is substantially similarly formed. Each contact member 61, 62 and 63 is received in one of the passageways formed between the openings in the rear surface 40 of the plug connector 31 and the openings in the front surface 36.

Figure 8:
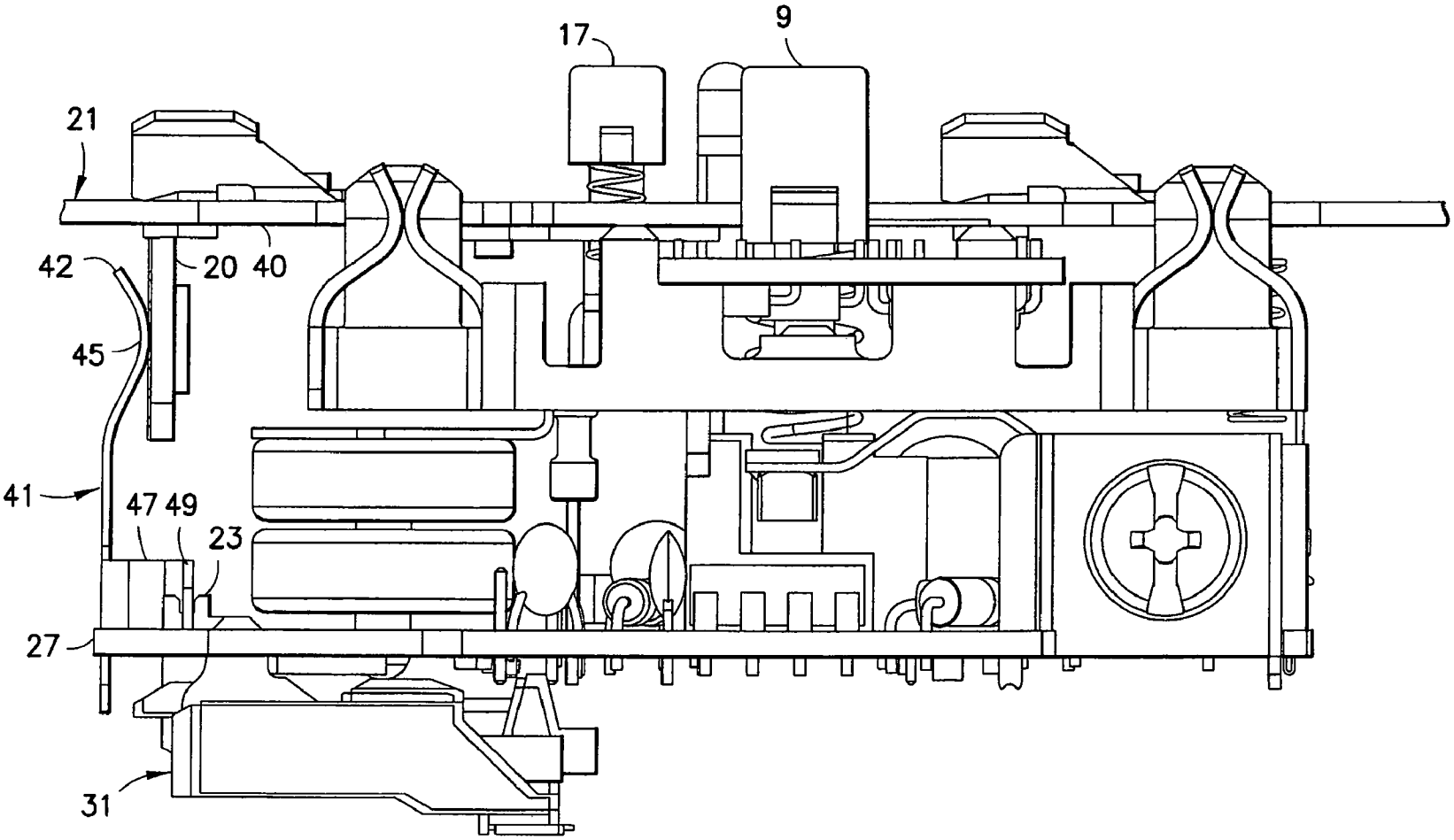
FIG. 8 is a side elevational view of the plug, contact blades, mounting strap and grounding member of FIG. 7.
Figure 9:
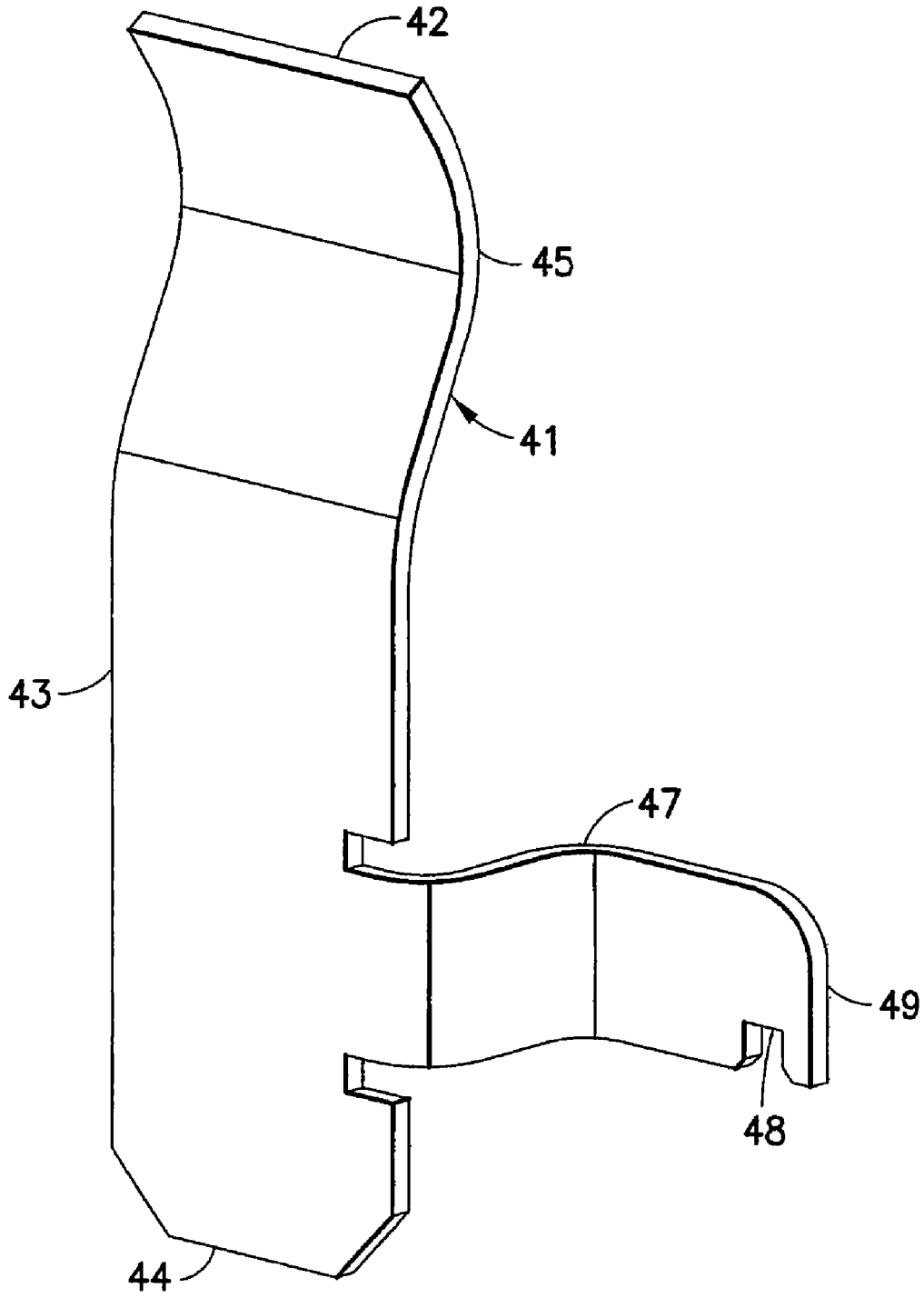
FIG. 9 is a perspective view of a grounding member for the GFCI device of FIG. 1.

The grounding member 41, as shown in FIGS. 9 and 10, has a main body 43 having first and second ends 42 and 44. The second end 44 is received by a recess in the base 15 of the receptacle 11. A curved portion 45 is formed in the grounding member 41 proximal the first end 42 and is adapted to engage the ground strap 21, as shown in FIGS. 7 and 8. Preferably, the curved portion 45 engages the tab 20 of the ground strap 21. A connecting arm extends 47 outwardly from the main body 43 of the grounding member 41. A notch 48 is formed proximal a free end 49 of the connecting arm 47 and is adapted to engage the notch 70 in the ground contact blade 23. Preferably, the connection between the connecting arm 47 and the ground contact blade 23 is soldered. The grounding member 41 is preferably formed as a unitary one-piece member.

Assembly and Operation

The contact blades 22, 23 and 24 are connected to the printed circuit board 27, preferably by soldering, and the circuit board is disposed in the base 15 such that the contact blades are accessible through the aperture 18 in the base. The grounding member 41 is connected to the ground contact blade 23, as shown in FIG. 7, by engaging the notches 48 and 60 of the grounding member 41 and ground contact blade 23, respectively. The notch 48 in the free end 49 of the grounding member 41 is substantially perpendicular to the notch 60 in the ground contact blade 23. The second end 44 of the grounding member 41 is preferably received by a recess in the base 15. Preferably, the connection between the grounding member 41 and ground contact blade 23 is soldered. The ground strap 21 is then disposed over the base 15 so that the tab 20 engages the curved portion 45 of the grounding member 41 and slightly bends the grounding member 41. Preferably, the connection between the ground tab 20 and the grounding member 41 is soldered so that the subassembly comprising the ground strap 21, the grounding member 41, the printed circuit board 27 and the contact blades 22, 23 and 24 can be disposed in the base 15 as a single unit.

The cover 13 is then connected to the base 15 by passing the downwardly extending posts 10 through pockets 14 of the base 15, thereby creating a snap fit to secure the cover to the base as shown in FIG. 1. The contact blades 22, 23 and 24 are accessible through the aperture 18 in the rear surface 19 of the base 15, as shown in FIG. 4.

Wires 91, 92 and 93 are terminated by contact members 61, 62 and 63, as shown in FIG. 6. Insulation is removed from the end of the wires 91, 92 and 93 as required to facilitate terminating the wires with the contact members 61, 62 and 63. Preferably, the wires 91, 92 and 93 are crimped to the contact members 61, 62 and 63. The contact members 61, 62 and 63 are secured within the plug connector 31, as shown in FIG. 5. The non-terminated ends of the wires 91, 92 and 93 may then be terminated to existing wires connected to a power distribution center by wire nuts, or any other suitable method, such that electrical power is transmitted to the plug connector 31.

The plug connector 31 is then ready to be connected to a GFCI device 11, as shown in FIGS. 2 and 3. The electrical receptacle 10 has a rear face 14 having the aperture 18 therein adapted to receive the plug connector 31. The contact blades 22, 23 and 24 are accessible through the aperture 18. The perimeter wall 97 facilitates guiding the plug connector 31 into the aperture 18. Each contact member 61, 62 and 63 of the plug connector 31 mechanically and electrically connects with a corresponding contact blade 22, 23 and 24 within the aperture 18. The contact blades 22, 23 and 24 pass through the slots 51, 52 and 53 in the upper surface 54 of the plug connector 31 to engage the contact members 61, 62 and 63. The contact blades are received within the gripping portion formed by the curved portions 66 and 69 of the flexible fingers 64 and 65 of each contact member 61, 62 and 63. The plug connector 31 is rotated or pivoted into the aperture 18 until the latching arms 55 and 56 pass through the openings 25 and 26 in the rear surface 19 of the base 15, thereby creating a snap fit between the plug connector 31 and the GFCI device 11, as shown in FIGS. 2 and 3. The tabs 57 and 58 engage the inner surface of the base 15, thereby preventing accidental withdrawal of the plug connector 31 from the aperture 18. Depressing the tabs 57 and 58, which are accessible through the openings 25 and 26, deflects the latching arms 55 and 56 outwardly, such that the plug connector 31 can be withdrawn from the GFCI device 11. A tool, such as a screwdriver, may be used to access the tabs 57 and 58 of the latching members 55 and 56 through the openings 25 and 26.

When the plug connector 31 is connected to the contact blades 22, 23 and 24 of the GFCI device 11, electrical power is transmitted through the plug connector 31 to a device plugged into the openings 1-3 and 6-8 in the front surface of the GFCI device 11. The wires 91, 92 and 93 run substantially parallel to the rear surface 19 of the GFCI device 11. A ground path is provided between the ground contact blade 23 and the ground strap 21 by the grounding member 41.

The grounding member 41 provides a relatively direct connection between the ground strap 21 and the ground contact blade 23, thereby allowing the ground strap, contact blades and grounding member to be assembled quickly while providing a low profile. Additionally, the configuration of the plug connector 31 and the wires terminated thereby provide an electrical device assembly having a low profile.

While one advantageous embodiment has been chosen to illustrate the invention, it will be understood by those skilled in the art that various changes and modifications may be made therein without departing from the scope of the invention as defined in the appended claims.

What is claimed is:

1. An electrical device assembly, comprising:

an electrical device including a housing having a rear surface and an aperture in said rear surface, a ground strap connected to said housing and securable to an electrical box, a plurality of contact blades disposed in said electrical device and accessible through said aperture, one of said contact blades being a ground contact blade, and a grounding member electrically connecting said ground contact blade and said ground strap; and a plug connector receivable in said aperture of said electrical device and including a plurality of contact members engagable with said plurality of contact blades in said electrical device, and a plurality of wires extending outwardly from said plurality of contact members substantially parallel to said rear surface of said electrical device when said plug connector is connected to said electrical device.

2. The electrical device assembly of claim 1, wherein said electrical device is a ground fault circuit interrupter (GFCI) receptacle.

3. The electrical device assembly of claim 1, wherein said plurality of contact blades are connected to a printed circuit board.

4. The electrical device assembly of claim 1, wherein said grounding member has a base having first and second ends and an arm extending outwardly from said base.

5. The electrical device assembly of claim 4, wherein said arm has a notch therein engaging said ground contact blade.

6. The electrical device assembly of claim 4, wherein said first end of said grounding member is received by a recess in a base of said electrical device.

7. The electrical device assembly of claim 6, wherein a curved portion is formed in said grounding member proximal said second end.

8. The electrical device assembly of claim 7, wherein said curved portion engages said ground strap.

9. The electrical device assembly of claim 8, wherein a ground tab extending outwardly from said ground strap engages said curved portion of said ground strap.

10. The electrical device assembly of claim 1, wherein a base of said electrical device has at least one opening therein; and said plug connector has at least one latching arm extending outwardly therefrom, said at least one latching arm being received by said at least one opening to form a snap connection between said connector plug and said electrical device.

11. The electrical device assembly of claim 10, wherein said at least one latching arm is substantially perpendicular to said plurality of wires.

12. The electrical device assembly of claim 1, wherein each of said plurality of wires extends substantially parallel to a longitudinal axis of said contact member to which said plurality of wires are connected.

13. A low profile ground fault circuit interrupter (GFCI) device assembly, comprising:

a GFCI device including a housing having a rear surface and an aperture in said rear surface, a ground strap passing through said housing and securable to an electrical box, a circuit board disposed in said housing, a plurality of contact blades connected to said circuit board and accessible through said aperture, one of said contact blades being a ground contact blade; and a grounding member electrically connecting said ground contact blade and said ground strap; and a plug connector receivable in said aperture of said GFCI device and including a plurality of contact members engagable with said plurality of contact blades in said GFCI device, and a plurality of wires extending outwardly from said plurality of contact members substantially parallel to a longitudinal axis of one of said plurality of contact members to which said wire is connected.

14. The GFCI device assembly of claim 13, wherein said grounding member has a base having first and second ends and an arm extending outwardly from said base.

15. The GFCI device assembly of claim 14, wherein said arm has a notch therein for engaging said ground contact blade.

16. The GFCI device assembly of claim 15, wherein said ground contact blade has a corresponding notch for engaging said notch of said arm.

17. The GFCI device assembly of claim 16, wherein a curved portion is formed in said grounding member proximal said second end and engages said ground strap.

18. The GFCI device assembly of claim 17, wherein a ground tab extending downwardly from said ground strap toward said circuit board engages said curved portion of said ground strap.

19. The GFCI device assembly of claim 13, wherein a base of said electrical device has at least one opening therein; and said plug connector has at least one latching arm extending outwardly therefrom, said at least one latching arm being received by said at least one opening to form a snap connection between said connector plug and said electrical device.

20. The GFCI device assembly of claim 19, wherein said at least one latching arm is substantially perpendicular to said plurality of wires.

* * * * *